United States Patent [19]

Kurosawa et al.

[11] 4,433,209

[45] Feb. 21, 1984

[54] STEREO/MONAURAL SELECTING CIRCUIT

[75] Inventors: Nobuyuki Kurosawa, Yokohama; Kazuaki Suda, Asaka, both of Japan

[73] Assignee: Sony Corporation, Tokyo, Japan

[21] Appl. No.: 257,392

[22] Filed: Apr. 24, 1981

[30] Foreign Application Priority Data

Apr. 25, 1980 [JP] Japan ..... 55-56801[U]

[51] Int. Cl.[3] ..... H04S 7/00

[52] U.S. Cl. ..... 381/1; 179/156 R; 381/25; 381/119

[58] Field of Search ..... 179/1 G, 101, 107 R, 179/1 C, 1 PC, 1 GM, 1 SW, 156 R; 455/66, 137, 351

[56] References Cited

U.S. PATENT DOCUMENTS 4,046,973 9/1977 Sato ..... 179/1 G X
4,151,470 4/1979 Sato ..... 179/1 G X
4,219,789 8/1980 Frangos ..... 179/1 R X

FOREIGN PATENT DOCUMENTS 1358029 6/1979 United Kingdom ..... 179/1 SW

*Primary Examiner*—R. J. Hickey
*Attorney, Agent, or Firm*—Lewis H. Eslinger; Alvin Sinderbrand

[57] ABSTRACT

The present invention is directed to a stereo/monaural selecting circuit having a jack for supplying therefrom for reproduction a stereophonic sound signal output or a monaural sound signal output to apparatus connected thereto, or for receiving for recording a stereophonic sound signal input or a monaural sound signal input from apparatus connected thereto. The jack can be used with either a binaural plug or a monaural plug inserted thereinto, which are attached to stereophonic apparatus or monaural apparatus, respectively, and the circuit selects automatically either a stereophonic operating state or a monaural operating state in response to the type of plug inserted into the jack. In the case where the circuit contains a speaker, the circuit supplies the monaural sound signal output to the speaker when no plug is inserted into the jack.

19 Claims, 9 Drawing Figures

STEREO/MONAURAL SELECTING CIRCUIT

BACKGROUND OF THE INVENTION

This invention relates generally to a stereo/monaural selecting circuit which is operative to select automatically either a stereophonic operating state or a monaural operating state, and more particularly, is directed to a stereo/monaural selecting circuit for selectively rendering operative an amplifier section contained therein in either a stereophonic operating state or a monaural operating state in response to the existence or type of plug inserted into a jack provided.

Previously proposed compact stereophonic sound reproducing apparatus include a single speaker due to lack of enough space, and a sterephonic jack is provided. In the case where such a single speaker is utilized to reproduce sound, one channel signal of a stereophonic sound signal is supplied to the speaker to reproduce monaural sound. Stereophonic sound is reproduced by a stereophonic headphone having a binaural plug which is inserted into the stereophonic jack.

In the sound reproducing operation by the speaker mentioned above, there is the disadvantage that a listener hears an unnatural or strange sound even when the stereophonic sound signals in the left and right channels (L- and R-channels) represent ordinary stereophonic music, and further, the listener fails to hear some necessary information when the stereophonic sound signals in the L- and R-channels have different information from each other, because the sound which is heard is reproduced from only one of the stereophonic sound channel signals transmitted in the L- and R-channels, respectively. In order to avoid such disadvantage, it may be proposed to supply both of the stereophonic sound channel signals in the L- and R-channels to the speaker for reproducing sound by the speaker, and to supply separately each of the stereophonic sound signals in the L- and R-channels to the stereophonic headphone in the case of a sound reproducing operation by the stereophonic headphone. However, in this case, it is required that a first manual switch for selecting either the speaker or the stereophonic headphone and another second manual switch for selecting either the monaural operating state or the stereophonic operating state for the circuit be provided at the outside of the apparatus. This results in a relatively complicated construction and operation.

Further, a stereophonic sound reproducing apparatus is generally required to reproduce sound with not only a stereophonic headphone but also with a monaural earphone. For this purpose, a monaural jack is provided in the apparatus in addition to the stereophonic jack. This results in undesirable problems in space occupation in the apparatus and in usability of the apparatus. In addition, the sound reproducing operation by the monaural earphone has the same disadvantages as those inherent in the sound reproducing operation by the speaker, as aforementioned.

Such problems and disadvantages as mentioned above also occur with stereophonic sound recording apparatus. In the previously proposed stereophonic sound recording apparatus which is used with outer plugs supplying sound signals to be recorded, each of which may be attached to a microphone, a couple of independent jacks are provided further L- and R-recording channels, respectively, to receive the plugs, and in order to accomplish recording of the monaural sound signal, both sound signals supplied from the plugs to the L- and R-recording channels are mixed or one of these sound signals only is selected. Such stereophonic sound recording apparatus is complicated in circuit construction and difficult to control.

SUMMARY OF THE INVENTION

Accordingly, it is an object of the present invention to provide a novel stereo/monaural selecting circuit that avoids the above-described difficulties encountered with the previously proposed stereophonic sound reproducing and/or recording apparatus.

Another object of the present invention is to provide a stereo/monaural selecting circuit which is operative to select automatically either a stereophonic sound signal output or a monaural sound signal output without using a manually controlled switch device.

Still another object of the present invention is to provide a stereo/monaural selecting circuit which accurately selects either a stereophonic sound signal output or a monaural sound signal output and which is simple in construction.

Yet another object of the present invention is to provide a stereo/monaural selecting circuit having an improved jack-connecting circuit which occupies a limited space so as to be suitable for a compact stereophonic sound reproducing and/or recording apparatus.

A further object of the present invention is to provide a stereo/monaural selecting circuit which is easy to control.

A still further object of the present invention is to provide a stereo/monaural selecting circuit which is adapted to be operative to always produce a pair of sound signal outputs which can be supplied to a stereophonic headphone.

A yet further object of the present invention is to provide a stereo/monaural selecting circuit having a jack to which either one of a binaural plug and a monaural plug can be connected.

In accordance with an aspect of this invention, a stereo/monaural selecting circuit includes first and second signal transmission channels for transmitting first and second signals, respectively; first and second amplifying means provided in the first and second signal transmission channels, respectively; a first binaural connecting device having first and second signal terminals connected to the first and second amplifying means, respectively; mixing means provided between the first and second signal transmission channels to mix the first and second signals; and controlling means connected to the mixing means for rendering the mixing means inoperative when the first binaural connecting device is connected with a second binaural connecting device having corresponding first and second signal terminals.

The above, and other, objects, features and advantages of the present invention will be apparent from the following detailed description of certain preferred embodiments thereof which is to be read in connection with the accompanying drawings.

DETAILED DESCRIPTION OF THE PREFERRED EMBODIMENTS

Figure 1:
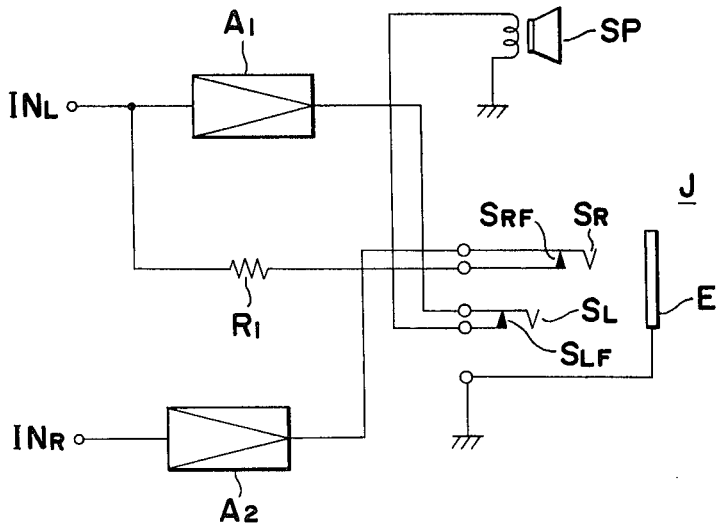
FIG. 1 is a schematic circuit wiring diagram of a selecting circuit according to a first embodiment of the present invention.

Referring to the drawings in detail, and initially to FIG. 1 thereof, the fundamental construction of a stereo/monaural selecting circuit according to one embodiment of the present invention includes a first amplifier $A_1$ which amplifies one channel signal of a stereophonic sound signal, for example, a left or L-channel signal, and transmits the L-channel signal which is supplied from an input terminal $IN_L$ to a movable contact $S_L$ of a stereophonic jack J. A second amplifier $A_2$ amplifies the other channel signal of the stereophonic sound signal, for example, a right or R-channel signal, and transmits the R-channel signal which is supplied from an input terminal $IN_R$ to a movable contact $S_R$ of the stereophonic jack J. Fixed contacts $S_{LF}$ and $S_{RF}$ are positioned against the movable contacts $S_L$ and $S_R$, respectively, and both pairs of the movable contact $S_L$ and the fixed contact $S_{LF}$ and of the movable contact $S_R$ and the fixed contact $S_{RF}$ form switches normally closed, respectively. The fixed contact $S_{RF}$ of one of these switches is connected to an input of amplifier $A_1$ through a resistor $R_1$, and the fixed contact $S_{LF}$ of the other of these switches is connected to one terminal of a speaker SP. A ground terminal E of jack J and the other terminal of speaker SP are both grounded.

The operation of the circuit shown in FIG. 1 will now be explained. If no plug is inserted into jack J, the switches formed by movable contact $S_L$ and fixed contact $S_{LF}$ and by movable contact $S_R$ and fixed contact $S_{RF}$, respectively, are closed so that the R-channel signal derived from amplifier $A_2$ is supplied to amplifier $A_1$ through movable contact $S_R$, fixed contact $S_{RF}$ and resistor $R_1$. As a result of this, a mixed output of the L-channel signal and the R-channel signal is obtained at the output of amplifier $A_1$. This mixed output is supplied to speaker SP through movable contact $S_L$ and fixed contact $S_{LF}$, and a monaural sound reproduced from both the L-channel signal and the R-channel signal which are mixed with each other is obtained at speaker SP.

Figure 2A:
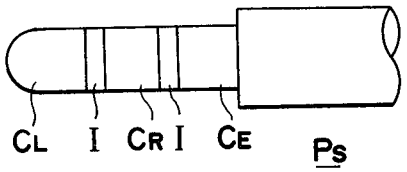
FIG. 2A is a schematic plan view of a binaural plug that can be used with a stereo/monaural selecting circuit according to the present invention.

On the other hand, were a binaural plug $P_S$, as shown in FIG. 2A, which is attached to, for example, a stereophonic headphone, is inserted into jack J, a different result occurs. The binaural plug $P_S$ is formed as a single-head, three-pole type plug which is provided from its end portion with a terminal $C_L$ for the L-channel signal, a terminal $C_R$ for the R-channel signal and a ground terminal $C_E$ in that order, an isolating portion I placed between adjacent terminals. When binaural plug $P_S$ is inserted into jack J, terminals $C_L$ and $C_R$ are connected to movable contacts $S_L$ and $S_R$, respectively, and at the same time, movable contacts $S_L$ and $S_R$ are removed from fixed contacts $S_{LF}$ and $S_{RF}$, respectively, so that the switches formed by these contacts are kept open. Accordingly, the output of amplifier $A_1$ is not supplied to speaker SP, but rather, is supplied to an L-channel speaker contained in the stereophonic headphone through movable contact $S_L$ and terminal $C_L$, and the output of amplifier $A_2$ is not supplied to the input of amplifier $A_1$, but rather, is supplied to an R-channel speaker contained in the stereophonic headphone through movable contact $S_R$ and terminal $C_R$. As a result, when binaural plug $P_S$ is inserted into jack J, speaker SP does not reproduce any sound so that a listener utilizing the stereophonic headphone can enjoy the reproduced stereophonic sound without others having to listen to the sound.

However, in the embodiment shown in FIG. 1, since both outputs from amplifiers $A_1$ and $A_2$ can be supplied directly to either the stereophonic jack J or speaker SP, there will be a difference between the level of the sound reproduced by speaker SP and the level of the sound reproduced by the stereophonic headphone in accordance with different impedance values of speaker SP and the stereophonic headphone so that the level control for the reproduced sound will have to be adjusted whenever either speaker SP or the stereophonic headphone is selected. Another embodiment of this invention, as shown in FIG. 3, which constitutes an improvement over the above described apparatus and which is directed to this point of view, will now be described.

Figure 3:
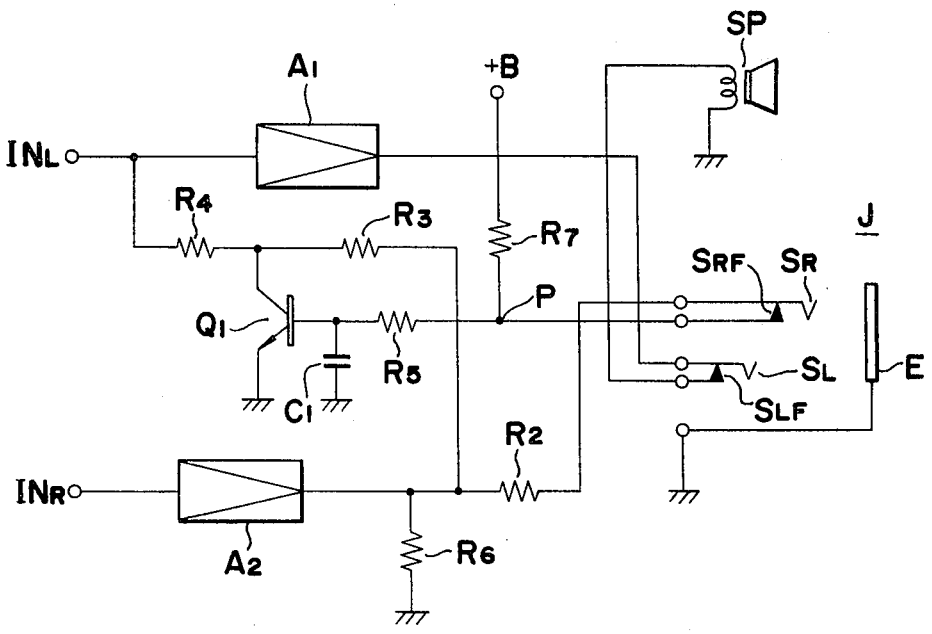
FIG. 3 is a schematic circuit wiring diagram of a selecting circuit according to a second embodiment of the present invention.

In the circuit shown in FIG. 3, the output of amplifier $A_2$ which amplifies the R-channel signal is connected to movable contact $S_R$ of stereophonic jack J through a protective resistor $R_2$ and is also connected to the input of amplifier $A_1$, which amplifies the L-channel signal, through resistors $R_3$ and $R_4$ coupled in series. Further, a transistor $Q_1$ is provided with its collector connected to the connecting point between resistors $R_3$ and $R_4$ and its emitter being grounded. The base of transistor $Q_1$ is connected to fixed contact $S_{RF}$ of jack J through a resistor $R_5$ and is also grounded through a capacitor $C_1$. Moreover, the output of amplifier $A_2$ is grounded through a resistor $R_6$, and a connecting point P between resistor $R_5$ and fixed contact $S_{RF}$ is connected to a voltage source +B through a resistor $R_7$, so that potentials at various parts of the circuit can be determined.

The operation of the circuit shown in FIG. 3 will now be explained. First, where binaural plug $P_S$ is not inserted into jack J, a series connection consisting of resistor $R_7$, fixed contact $S_{RF}$, movable contact $S_R$, resistor $R_2$ and resistor $R_6$ is formed between voltage source +B and ground. The resistors $R_2$ and $R_6$ are selected to have a sufficiently lower resistance value than resistor $R_7$, so that the potential at connecting point P does not render transistor $Q_1$ conductive. Accordingly, transistor $Q_1$ remains nonconductive and the output of amplifier $A_2$ is supplied to the input of amplifier $A_1$ through resistors $R_3$ and $R_4$. Consequently, amplifier $A_1$ mixes both the L-channel signal and the R-channel signal and amplifies the mixed signal as a monaural signal, and then supplies it to speaker SP through movable contact $S_L$ and fixed contact $S_{LF}$. As a result, the monaural sound is reproduced by speaker SP. In this case, since capacitor $C_1$ is connected to the base of transistor $Q_1$, the potential at the base of transistor $Q_1$ is not varied by the sound signal component at the output of amplifier $A_2$.

On the other hand, where binaural plug $P_S$ shown in FIG. 2A, which is attached to the stereophonic headphone, is inserted into jack J, movable contacts $S_L$ and $S_R$ are removed from fixed contacts $S_{LF}$ and $S_{RF}$, and are connected to terminals $C_L$ and $C_R$ of binaural plug $P_S$, respectively. As a result of the removal of movable contact $S_R$ from fixed contact $S_{RF}$, the voltage from voltage source +B is supplied to the base of transistor $Q_1$ through resistors $R_7$ and $R_5$, so that transistor $Q_1$ becomes conductive. Therefore, the L-channel signal and the R-channel signal are grounded through resistors $R_4$ and $R_3$, respectively, and the R-channel signal is not mixed with the L-channel signal at amplifier $A_1$. Consequently, amplifier $A_1$ supplies the output of the L-channel signal to the stereophonic headphone through movable contact $S_L$, and amplifier $A_2$ supplies the output of the R-channel signal to the stereophonic headphone through movable contact $S_R$, so that stereophonic sound is reproduced by the stereophonic headphone.

In this embodiment, by means of varying the value of resistor $R_4$, the mixing gain can be adjusted when monaural sound is reproduced by speaker SP and the balance gain can be adjusted when stereophonic sound is reproduced by the stereophonic headphone. Accordingly, in comparison with the embodiment of FIG. 1, a much more delicate level control for the reproduced sound can be achieved during either sound reproducing by speaker SP or sound reproducing by the stereophonic headphone.

Figure 4:
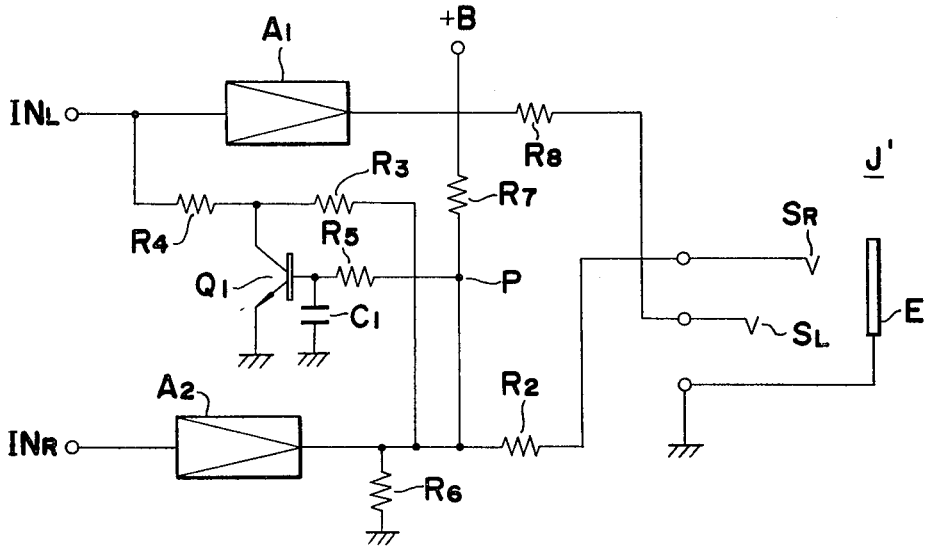
FIG. 4 is a schematic circuit wiring diagram of a selecting circuit according to a third embodiment of the present invention.

In the above described first and second embodiments, the monaural speaker or the stereophonic headphone is selected to reproduce the sound. However, it is also possible to use a monaural earphone in place of the monaural speaker. To use the monaural earphone, a jack which can be connected selectively to either the binaural plug or a monaural plug attached to the monaural earphone will be provided. Referring now to FIG. 4, a third embodiment of this invention is provided with a jack J' which has only movable contacts $S_L$ and $S_R$ and the ground terminal E and into which either the binaural plug or the monaural plug can be inserted, and is further provided with a resistor $R_8$ between the output of amplifier $A_1$ and movable contact $S_L$ of jack J'in order to provide a balance with protective resistor $R_2$. Other parts of the circuit are constructed similarly to the second embodiment shown in FIG. 3.

Now, as for the third embodiment shown in FIG. 4, when binaural plug $P_S$ shown in FIG. 2A is inserted into jack J', movable contacts $S_L$ and $S_R$ are connected to the load of the stereophonic headphone, that is, the left and right speakers contained in the stereophonic headphone through terminals $C_L$ and $C_R$, respectively. In this condition, the voltage of voltage source +B is divided by resistor $R_7$, resistor $R_2$ and a DC resistor component of the load of the stereophonic headphone connected to movable contact $S_R$, and a sufficient increased potential is obtained at connecting point P. This increased potential is supplied to the base of transistor $Q_1$ through resistor $R_5$, so that transistor $Q_1$ becomes conductive. Therefore, the L-channel signal and the R-channel signal are grounded through resistors $R_4$ and $R_3$, respectively, without being mixed with each other, and both outputs of amplifiers $A_1$ and $A_2$ are supplied separately to the stereophonic headphone through movable contacts $S_L$ and $S_R$, respectively. As a result, stereophonic sound is reproduced by the stereophonic headphone.

Figure 2B:
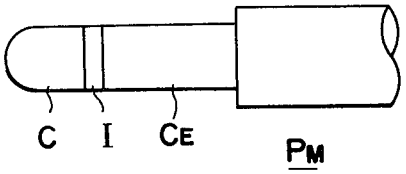
FIG. 2B is a schematic plan view of a monaural plug that can be used with a stereo/monaural selecting circuit according to the present invention.

The monaural plug $P_M$ that can be used with jack J' is shown in FIG. 2B. This monaural plug $P_M$ is formed as a single-head, two-pole type plug which is provided with an input terminal C at the portion of the plug corresponding to the position of terminal $C_L$ of binaural plug $P_S$, a ground terminal $C_E$ at the portion of the plug corresponding to the positions of terminal $C_R$ and the ground terminal of binaural plug $P_S$, and an isolating portion I therebetween.

When monaural plug $P_M$ shown in FIG. 2B and attached to a monaural earphone is inserted into jack J', since movable contact $S_R$ of jack J' is connected to ground terminal $C_E$ of monaural plug $P_M$ and is therefore grounded, the voltage of voltage source +B is divided by resistor $R_7$ and resistor $R_2$, and the potential at connecting point P, which corresponds to the divided voltage obtained across resistor $R_2$, is decreased compared with the potential thereat when binaural plug $P_S$ is inserted into jack J'. With this decreased potential at connecting point P, transistor $Q_1$ becomes nonconductive and the R-channel signal from amplifier $A_2$ is supplied to the input of amplifier $A_1$. The amplifier $A_1$ mixes the R-channel signal with the L-channel signal and amplifies the mixed signal as the monaural signal. The mixed signal from amplifier $A_1$ is supplied to the monaural earphone through movable contact $S_L$ which is connected to input terminal C of monaural plug $P_M$, so that monaural sound is reproduced by the monaural earphone.

As described above, with this embodiment of the invention, it is possible to select automatically either stereophonic sound reporduction or monaural sound reproduction by changing a plug.

Figure 5:
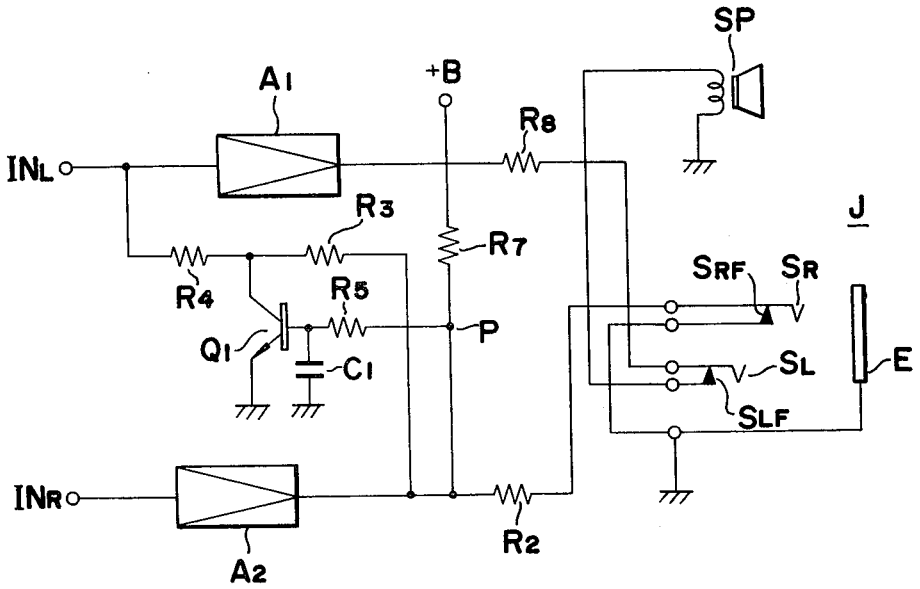
FIG. 5 is a schematic circuit wiring diagram of a selecting circuit according to a fourth embodiment of the present invention.

It is possible to add the monaural speaker as shown in FIG. 1 and FIG. 3 to the embodiment shown in FIG. 4. FIG. 5 shows a fourth embodiment of this invention with such added monaural speaker SP. In the fourth embodiment shown in FIG. 5, jack J having fixed contacts $S_{LF}$ and $S_{RF}$, as shown in FIG. 1 and FIG. 3, is employed in place of jack J' used in the embodiment shown in FIG. 4. The fixed contact $S_{LF}$ is connected to one of the terminals of speaker SP and fixed contact $S_{RF}$ and ground terminal E are grounded along with the other terminal of speaker SP. The resistor $R_6$ employed in the embodiment shown in FIG. 4 is not necessary any more due to the direct connection between fixed contact $S_{RF}$ and ground.

As for this fourth embodiment shown in FIG. 5, when neither binaural plug $P_S$ nor monaural plug $P_M$ are inserted into jack J, the voltage of voltage source +B is divided by resistor $R_7$ and resistor $R_2$ to provide a decreased potential at connecting point P so that transistor $Q_1$ becomes nonconductive. Accordingly, in the same manner as the condition of monaural sound reproduction in the embodiment shown in FIG. 4, amplifier $A_1$ produces a mixed signal comprised of the L- and R-channel signals and supplies it to speaker SP through movable contact $S_L$ and fixed contact $S_{LF}$.

On the other hand, when binaural plug $P_S$ is inserted into jack J, movable contacts $S_L$ and $S_R$ are removed from fixed contact $S_{Lf}$ and $S_{RF}$ and connected to terminals $C_L$ and $C_R$ of binaural plug $P_S$, respectively, and therefore, stereophonic sound is reproduced in the same manner as the condition during stereophonic sound reproduction in the embodiment of FIG. 4.

Further, when monaural plug $P_M$ is inserted into jack J, movable contact $S_R$ is removed from $S_{RF}$ and connected to ground terminal $C_E$ of monaural plug $P_M$ so as to be grounded, and therefore, monaural sound is reproduced in the same manner as the condition during monaural sound reproduction in the embodiment shown in FIG. 4.

The circuit in each of the aforementioned embodiments is provided with a single jack J or J' and, when the jack is connected to the plug, the speaker is not supplied with the sound signal and does not reproduce the sound. Accordingly, a single listener can enjoy the sound reproduced thereby. If it is required to provide at least two listeners with the reproduced sound, it is necessary for the circuit to have at least two jacks. The following embodiments are proposed as improvements toward this point of view.

Figure 6:
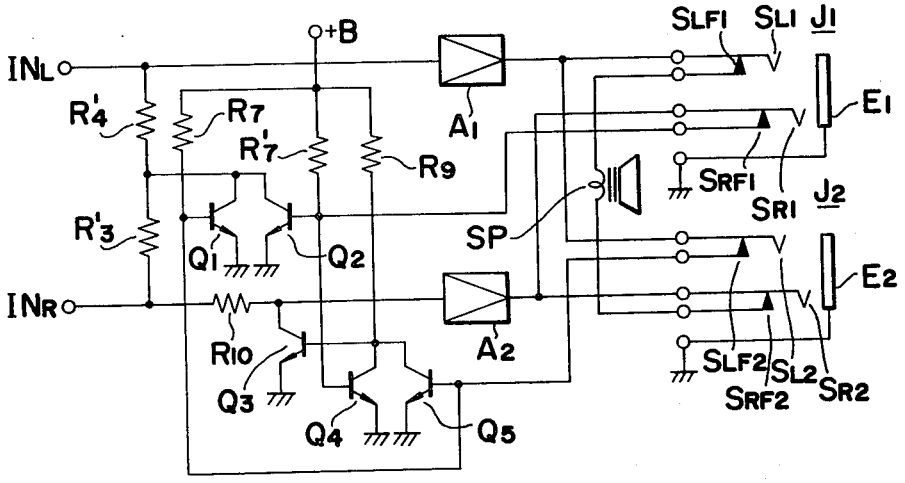
FIG. 6 is a schematic circuit wiring diagram of a selecting circuit according to a fifth embodiment of thepresent invention.

As for a fifth embodiment shown in FIG. 6, a couple of jacks $J_1$ and $J_2$, each of which is similar to jack J shown in FIGS. 1, 3 and 5, are provided. The jack $J_1$ has movable contacts $S_{L1}$ and $S_{R1}$ and fixed contacts $S_{LF1}$ and $S_{RF1}$, and jack $J_2$ has movable contacts $S_{L2}$ and $S_{R2}$ and fixed contacts $S_{LF2}$ and $S_{RF2}$. Ground terminals $E_1$ and $E_2$ of jacks $J_1$ and $J_2$ are grounded. The movable contacts $S_{L1}$ and $S_{L2}$ are supplied with the output of amplifier $A_1$ and movable contacts $S_{R1}$ and $S_{R2}$ are supplied with the output of amplifier $A_2$. Further, speaker SP is connected between fixed contacts $S_{LF2}$ and $S_{RF2}$. In place of resistors $R_3$ and $R_4$ used for mixing the L- and R-channel signals in the circuits of FIGS. 3 and 5, resistors $R'_3$ and $R'_4$ are connected in series between the inputs of amplifiers $A_1$ and $A_2$, that is, between input terminals $IN_L$ and $IN_R$, and the collector of transistor $Q_1$ is connected to a connecting point between resistors $R'_3$ and $R'_4$. An additional transistor $Q_2$ is provided in relation to the employment of jacks $J_1$ and $J_2$ with its collector connected in the same manner as the collector of transistor $Q_1$. The bases of transistors $Q_1$ and $Q_2$ are connected to fixed contact $S_{LF2}$ of jack $J_2$ and fixed contact $S_{RF1}$ of jack $J_1$, respectively, and are also connected to voltage source +B through resistor $R_7$ and a resistor $R'_7$, respectively. The emitters of transistors $Q_1$ and $Q_2$ are grounded. Furthermore, since the L- and R-channel signals are mixed with each other at the input end of the circuit, switching transistors $Q_3$, $Q_4$ and $Q_5$ are provided for cutting off one of channels, for example, the R-channel, when mixing of the L- and R-channel signals is performed. The collector of transistor $Q_3$ is connected to the input of amplifier $A_2$ and the emitter thereof is grounded. The base of transistor $Q_3$ is connected to voltage source +B through a resistor $R_9$ and is also connected to both of the collectors of transistors $Q_4$ and $Q_5$. The bases of transistors $Q_4$ and $Q_5$ are connected to fixed contact $S_{RF2}$ of jack $J_1$ and fixed contact $S_{LF2}$ of jack $J_2$, respectively, similarly to the connection of the bases of transistors $Q_2$ and $Q_1$, and the emitters of transistors $Q_4$ and $Q_5$ are grounded.

The operation of this fifth embodiment will now be explained. When binaural plug $P_S$ is not inserted into each of jacks $J_1$ and $J_2$ shown in FIG. 6, movable contacts $S_{L1}$ and $S_{R1}$ are connected to fixed contacts $S_{LF1}$ and $S_{RF1}$, respectively, in jack $J_1$, and movable contacts $S_{L2}$ and $S_{R2}$ are connected to fixed contacts $S_{LF2}$ and $S_{RF2}$, respectively, in jack $J_2$. Therefore, the voltage of voltage source +B is divided by resistor $R_7$ and the output impedance of amplifier $A_1$, or resistor $R'_7$ and the output impedance of amplifier $A_2$, and both bases of transistors $Q_2$ and $Q_4$ are provided with a common low potential so that transistors $Q_2$ and $Q_4$ become nonconductive. The transistors $Q_1$ and $Q_5$ become nonconductive similarly. To the contrary, transistor $Q_3$ becomes conductive with a high potential supplied to its base due to the nonconductive state of transistors $Q_4$ and $Q_5$. Accordingly, although the R-channel signal from input terminal $IN_R$ is grounded through transistor $Q_3$ and is therefore not supplied to amplifier $A_2$, it is transmitted to the L-channel through resistors $R'_3$ and $R'_4$ because transistors $Q_1$ and $Q_2$ are nonconductive. This R-channel signal is amplified by amplifier $A_1$ together with the L-channel signal from input terminal $IN_L$ and supplied to one of the terminals of speaker SP together with the L-channel signal through movable contact $S_{L1}$ and fixed contact $S_{LF1}$ of jack $J_1$. The other terminal of speaker SP is substantially grounded because the input of amplifier $A_2$ is grounded through transistor $Q_3$, though it is connected to the output of amplifier $A_2$ through fixed contact $S_{RF2}$ and movable contact $S_{R2}$ of jack $J_2$. As a result, monaural sound is reproduced by speaker SP from the mixed L- and R-channel signals supplied thereto.

In the case where binaural plug $P_S$ is inserted into jack $J_1$, the movable contacts $S_{L1}$ and $S_{R1}$ are removed from fixed contacts $S_{LF1}$ and $S_{RF1}$, so that speaker SP is disconnected from amplifier $A_1$. The transistors $Q_1$ and $Q_5$ are still nonconductive because jack $J_2$ does not receive any plug, but transistors $Q_2$ and $Q_4$ become conductive, and therefore, transistor $Q_3$ becomes nonconductive. Accordingly, the R-channel signal from input terminal $IN_R$ is amplified by amplifier $A_2$ and supplied to movable contact $S_{R1}$ of jack $J_1$. Since the L-channel signal is still supplied to movable contact $S_{L1}$ in this condition, stereophonic sound signals are derived from binaural plug $P_S$ which is inserted into jack $J_1$. In this case, because transistor $Q_2$ is maintained conductive, neither the L-channel signal nor the R-channel signal is supplied to the other channel.

In the case where binaural plug $P_S$ is inserted into only jack $J_2$, or a couple of binaural plugs $P_S$ are inserted into jacks $J_1$ and $J_2$, respectively, stereophonic sound signals are derived from each binaural plugs $P_S$ similarly to the above case.

Figure 7:
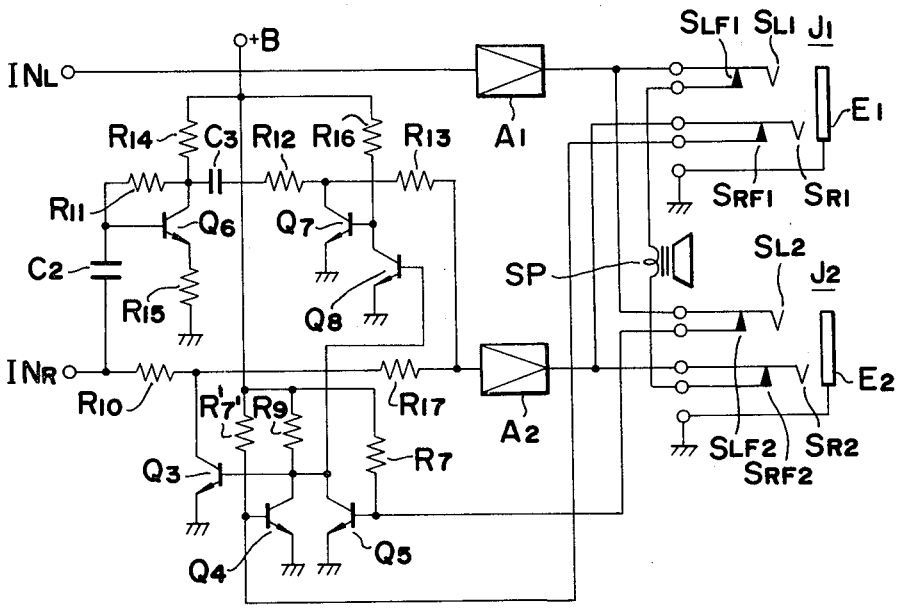
FIG. 7 is a schematic circuit wiring diagram of a selecting circuit according to a sixth embodiment of the present invention.

Although only amplifier $A_1$ is utilized to produce the monaural sound signal in the above mentioned fifth embodiment, it is possible to have a so called BTL (Balanced Transformerless) operation to increase the monaural sound signal output by supplying the R-channel signal with an inverted phase to amplifier $A_2$. FIG. 7 shows a sixth embodiment of this invention in which such BTL operation is performed. The circuit of FIG. 7 has a fundamental construction almost the same as the circuit shown in FIG. 6. However, in place of resistors $R'_3$ and $R'_4$ for mixing the L- and R-channel signals, a phase inverting circuit is provided, where the base of a transistor $Q_6$ for phase-inverting is connected to one of the input terminals, for example, input terminal $IN_R$ through a capacitor $C_2$. The base of transistor $Q_6$ is also connected to the collector of transistor $Q_6$ through a resistor $R_{11}$. This collector is connected to the input of amplifier $A_2$ through a capacitor $C_3$ and resistors $R_{12}$ and $R_{13}$, and is also connected to voltage source +B through a resistor $R_{14}$. The emitter of transistor $Q_6$ is grounded through a resistor $R_{15}$. Furthermore, a connecting point between resistors $R_{12}$ and $R_{13}$ is grounded through the collector-emitter path of a transistor $Q_7$.

The base of transistor $Q_7$ is connected to voltage source +B through a resistor $R_{16}$ and is grounded through the collector-emitter path of a transistor $Q_8$. The base of transistor $Q_8$ is connected to the collector of transistor $Q_5$. A resistor $R_{17}$ is connected between the collector of transistor $Q_3$ and the input of amplifier $A_2$.

The operation of this sixth embodiment will now be explained. Under the condition shown in FIG. 7, transistors $Q_4$ and $Q_5$ are nonconductive in the same manner as the case in FIG. 6, and therefore, transistor $Q_3$ is maintained conductive, so that a transmitting path for the R-channel signal with a non-inverted phase is grounded through transistor $Q_3$. The transistor $Q_7$ is maintained nonconductive when transistor $Q_8$ is conductive. Accordingly, the R-channel signal which is supplied to the base of transistor $Q_6$ through capacitor $C_2$ is inverted in phase by transistor $Q_6$ and supplied to amplifier $A_2$ from the collector of transistor $Q_6$ through capacitor $C_3$ and resistors $R_{12}$ and $R_{13}$, while the L-channel signal is supplied to amplifier $A_1$ with a non-inverted phase. Speaker SP is supplied at one of its terminals with the L-channel signal with the non-inverted phase derived from amplifier $A_1$ and is also supplied at its other terminal with the R-channel signal with the inverted phase derived from amplifier $A_2$, and both the L- and R-signals are added to each other at a voice coil of speaker SP to reproduce the monaural sound. In this case, the output sound from speaker SP is greatly magnified compared with the output sound in the embodiment shown in FIG. 6, because both amplifiers $A_1$ and $A_2$ are utilized.

On the other hand, when binaural plug $P_S$ is inserted into either jack $J_1$ or the jack $J_2$, since transistor $Q_4$ or $Q_5$ becomes conductive, both transistors $Q_3$ and $Q_8$ become nonconductive, and therefore, the transmitting path for the R-channel signal with the inverted phase is grounded through transistor $Q_7$. Consequently, the L- and R-channel signals both having a non-inverted phase appear at movable contacts $S_{L1}$ and $S_{L2}$ and movable contacts $S_{R1}$ and $S_{R2}$, respectively.

In the aforementioned embodiments shown in FIGS. 1, 3, 5 and 7, it is possible to provide an output terminal for the monaural sound signal in place of monaural speaker SP.

Although all of the above described embodiments of the present invention are applied to a stereophonic sound reproducing apparatus, it is also possible to apply the stereo/monaural selecting circuit according this invention to stereophonic sound recording apparatus. In otherwords, the present invention is also directed to a stereo/monaural selecting circuit having a jack for a recording apparatus to record the stereophonic sound signal when a plug attached to a stereophonic microphone is inserted into the jack and the monaural sound signal when a plug attached to a monaural microphone is inserted into the jack.

Figure 8:
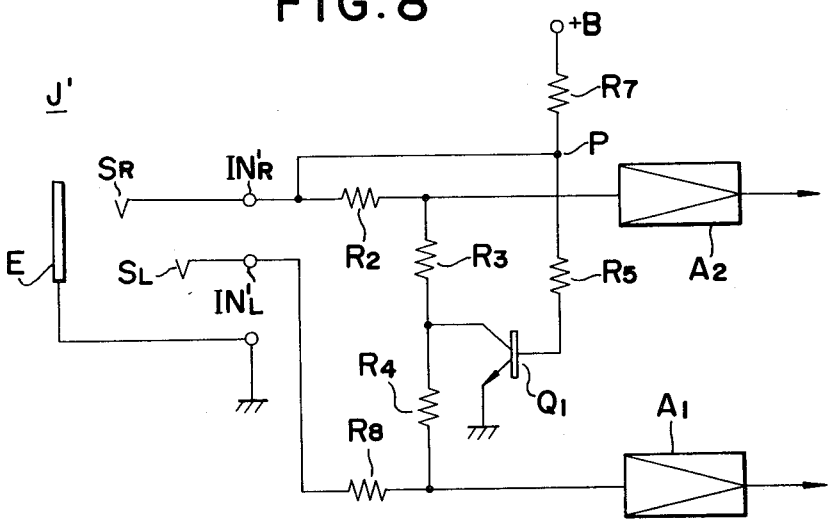
FIG. 8 is a schematic circuit wiring diagram of a selecting circuit according to a seventh embodiment of the present invention.

FIG. 8 shows a seventh embodiment of the present invention applied to a stereophonic sound recording apparatus. In this circuit, a jack J', such as shown in FIG. 4, which has only movable contacts $S_L$ and $S_R$ and a ground terminal E, is employed. The movable contacts $S_L$ and $S_R$ are connected to input terminals $IN'_L$ and $IN'_R$ of the L- and R-channels, respectively. These input terminals $IN'_L$ and $IN'_R$ are connected to amplifiers $A_1$ and $A_2$ through resistors $R_8$ and $R_2$, respectively. The resistors $R_3$ and $R_4$ are connected in series between the inputs of amplifiers $A_1$ and $A_2$ for mixing the L- and R-channel signals, and the connecting point between resistors $R_3$ and $R_4$ is grounded through the collector-emitter path of a switching transistor $Q_1$. The base of transistor $Q_1$ is connected to voltage source +B through resistors $R_5$ and $R_7$ with the connecting point P therebetween connected to input terminal $IN'_R$.

As for this embodiment of FIG. 8, when binaural plug $P_S$ shown in FIG. 2A, which is attached to a stereophonic microphone, is inserted into jack J', the voltage of voltage source +B is divided by the resistor $R_7$ and the output DC resistor of the stereophonic microphone connected to movable contact $S_R$ to determine the potential at connecting point P. The output DC resistor of the stereophonic microphone has a sufficiently larger value than resistor $R_7$, so that the potential at connecting point P is maintained relatively high. This relatively high potential is supplied to the base of transistor $Q_1$ through resistor $R_5$, and transistor $Q_1$ thereby becomes conductive. Accordingly, the L- and R-channel signals having passed through movable contacts $S_L$ and $S_R$, respectively, are grounded through resistor $R_3$ and $R_4$, respectively, without being mixed with each other and are amplified by amplifiers $A_1$ and $A_2$ so as to be recorded.

Meanwhile, when monaural plug $P_M$ shown in FIG. 2B, which is attached to a monaural microphone, is inserted into jack J', since movable contact $S_R$ of jack J' is connected to ground terminal $C_E$ of plug $P_M$ and is thereby grounded, the voltage from voltage source +B is applied across resistor $R_7$, and the potential at connecting point P is equal to ground potential, so that transistor $Q_1$ becomes nonconductive. Accordingly, the R-channel signal having passed through resistor $R_2$ is supplied to amplifier $A_1$ through resistors $R_3$ and $R_4$, and amplifier $A_1$ amplifies both the L- and R-channel signals together to produce a mixed output as a monaural sound signal to be recorded. Further, amplifier $A_2$ also produces a mixed output as a monaural sound signal to be recorded in the same manner.

As mentioned above, the circuit shown in FIG. 8 is operative to select automatically either recording of the stereophonic sound signals or recording of the monaural sound signal in response to the type of plug inserted into the jack, namely, the stereophonic plug or the monaural plug.

Through the above disclosed embodiments of the present invention, it is possible to interchange first amplifier $A_1$ and second amplifier $A_2$ with second amplifier $A_2$ and first amplifier $A_1$, respectively, and it is also possible to replace switching transistors $Q_1$ to $Q_8$ with other switching devices.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A stereo/monaural selecting circuit comprising:

first and second signal transmission channels for transmitting first and second signals, respectively;

first and second amplifier means provided in said first and second transmission channels, respectively;

a first binaural connecting device having first and second signal terminals connected to said first and second amplifier means, respectively;

mixing means provided between said first and second signal transmission channels to mix said first and second signals; and controlling means including transistor means connected to said mixing means for automatically rendering said mixing means inoperative in response to said first binaural connecting device being connected with a second binaural connecting device having corresponding first and second signal terminals.

2. A stereo/monaural selecting circuit according to claim 1; further comprising:

speaker means connected between the first signal terminal of said first binaural connecting device and a reference potential.

3. A stereo/monaural selecting circuit comprising:

first amplifier means having an input and output and provided in a first of two stereophonic channels;

second amplifier means having an output and provided in the second of the stereophonic channels;

monaural output means;

stereophonic jack means having a couple of pairs of one movable contact and one fixed contact, each of said movable contacts being removed from the corresponding one of said fixed contacts when a binaural plug is inserted into said jack means;

first means for connecting the output of said first amplifier means to said monaural output means through one of said pairs of said one movable contact and said one fixed contact; and second means for connecting the output of said second amplifier means to the input of said first amplifier means through the other of said pairs of said one movable contact and said one fixed contact.

4. A stereo/monaural selecting circuit comprising:

first amplifier means having an input and an output and provided in a first of two stereophonic channels;

second amplifier means having an input and an output and provided in the second of the stereophonic channels;

stereophonic jack means having a couple of movable contacts connected to the outputs of said first and second amplifier means, respectively;

connecting means for connecting the output of said second amplifier means to the input of said first amplifier means; and switching means for preventing said connecting means from supplying the output of said second amplifier means to said first amplifier means when a binaural plug is inserted into said stereophonic jack means.

5. A stereo/monaural selecting circuit comprising:

first amplifier means having an input and an output and provided in a first of two stereophonic channels;

second amplifier means having an input and an output and provided in the second of the stereophonic channels;

first and second stereophonic jack means connected to the outputs of said first and second amplifier means, respectively;

monaural output means connected between the outputs of said first and second amplifier means through said first and second stereophonic jack means;

first switching means connected at the input of said second amplifier means for blocking an input signal supplied thereto; and second switching means for controlling said first switching means to cause the latter to block said input signal supplied to said second amplifier means when a binaural plug is inserted into at least one of said first and second stereophonic jack means.

6. A stereo/monaural selecting circuit comprising:

stereophonic jack means having a couple of movable contacts;

first amplifier means having an input and connected to one of said movable contacts;

second amplifier means having an input and connected to the other of said movable contacts;

circuit means for connecting the input of said second amplifier means to the input of said first amplifier means; and switching means associated with said circuit means for preventing a signal appearing at the input of said first amplifier means from being supplied to the input of said second amplifier means and for further preventing a signal appearing at the input of said second amplifier means from being supplied to the input of said first amplifier means when a binaural plug is inserted into said stereophonic jack means.

7. A stereo/monaural selecting circuit comprising:

first and second signal transmission channels for transmitting first and second channel signals, respectively;

first and second amplifying means provided in said first and second signal transmission channels, respectively;

binaural jack means having first and second signal terminals connected to said first and second amplifying means, respectively; for receiving one of a binaural plug device and a monaural plug device;

mixing means provided between said first and second signal transmission channels for mixing said first and second channel signals; and control means connected to said mixing means for automatically rendering said mixing means inoperative in response to when a said binaural plug device having corresponding first and second signal terminals being connected with said binaural jack means.

8. A stereo/monaural selecting circuit according to claim 1; in which said transistor means includes an output path connected between said mixing means and a reference potential, and an input supplied with a first potential when said first binaural connecting device is not connected with said second binaural connecting device so as to render said transistor means inoperative, and supplied with a second potential higher than said first potential when said first binaural connecting device is connected with said second binaural connecting device so as to render said transistor means inoperative.

9. A stereo/monaural selecting circuit according to claim 8; in which said controlling means further includes voltage supply means for producing a reference potential, means for supplying said reference potential to the input of said transistor means, and means for providing a low resistance path for said reference potential when said first binaural connecting device is not connected with said second binaural connecting device.

10. A stereo/monaural selecting circuit according to claim 1; further including monaural signal output means adapted to be supplied with said mixed first and second signals when a monaural plug device is connected with said first binaural connecting device.

11. A stereo/monaural selecting circuit according to claim 1; wherein said first amplifier means has an input and an output;

said second amplifier means has an input and an output;

the first and second signal terminals of said first binaural connecting device are connected to the outputs of said first and second amplifier means, respectively;

said mixing means includes connecting means for connecting the output of said second amplifier means to the input of said first amplifier means; and said transistor means includes switching means for preventing said connecting means from supplying the output of said second amplifier means to said first amplifier means when said second binaural connecting device is connected with said first binaural connecting device.

12. A stereo/monaural selecting circuit according to claim 1; further comprising:

a third binaural connecting device having first and second signal terminals connected to the outputs of said first and second amplifier means, respectively;

monaural output means connected between the outputs of said first and second amplifier means through one terminal of each of said first and third binaural connecting devices; and wherein said transistor means includes first switching means connected at the input of said second amplifier means for blocking an input signal supplied thereto; and second switching means for controlling said first switching means to cause the latter to block said input signal supplied to said second amplifier means when said second binaural connecting device is inserted into at least one of said first and third binaural connecting devices.

13. A stereo/monaural selecting circuit according to claim 1; wherein said first amplifier means has an input and is connected to said first signal terminal of said first binaural connecting device;

said second amplifier means has an input and is connected to said second signal terminal of said first binaural connecting device;

said mixing means includes circuit means for connecting the input of said second amplifier means to the input of said first amplifier means; and said transistor means is associated with said circuit means for preventing a signal appearing at the input of said first amplifier means from being supplied to the input of said second amplifier means and for further preventing a signal appearing at the input of said second amplifier means from being supplied to the input of said first amplifier means when said second binaural connecting devide is connected with said first binaural connecting device.

14. A stereo/monaural selecting circuit according to claim 3; further comprising speaker means connected between said monaural output means and a reference potential.

15. A stereo/monaural selecting circuit according to claim 9; further including monaural signal output means adapted to be supplied with said mixed first and second signals when a monaural plug device is connected with said first binaural connecting device.

16. A stereo/monaural selecting circuit comprising:

first and second signal transmission channels for transmitting first and second channel signals, respectively;

first and second amplifying means provided in said first and second signal transmission channels, respectively;

monaural signal output means;

jack means having first and second signal terminals connected to said first and second amplifying means, respectively for receiving one of a binaural plug device and a monaural plug device;

mixing means provided between said first and second signal transmission channels for mixing said first and second channel signals so as to provide said monaural signal output means with said mixed first and second channel signals; and control means connected to said mixing means for automatically rendering said mixing means inoperative in response to said binaural plug device having corresponding first and second signal terminals being connected with said jack means.

17. Apparatus according to claim 16; further comprising speaker means connected to said monaural signal output means.

18. A stereo/monaural selecting circuit comprising:

first amplifier means having an input and output and provided in a first of two stereophonic channels;

second amplifier means having an output and provided in the second of the two stereophonic channels;

monaural output means;

stereophonic jack means having a couple of pairs of one movable contact and one fixed contact, each of said movable contacts being removed from the corresponding one of said fixed contacts when a binaural plug is inserted into said jack means;

first means for connecting the output of said first amplifier means to said monaural output means through one of said pairs of said one movable contact and said one fixed contact; and second means for connecting the output of said second amplifier means to the input of said first amplifier means.

19. A stereo/monaural selecting circuit according to claim 18; further comprising speaker means connected between said monaural output means and a reference potential.

* * * * *